US005098313A

United States Patent [19]

Marsh et al.

[11] Patent Number: 5,098,313

[45] Date of Patent: Mar. 24, 1992

[54] CONNECTOR FOR MULTI-CONDUCTOR CABLES

[75] Inventors: Michael J. C. Marsh; Christian G. Ellenberger, both of Johannesburg, South Africa

[73] Assignee: C.S.I.R., South Africa

[21] Appl. No.: 660,816

[22] Filed: Feb. 26, 1991

[30] Foreign Application Priority Data

Apr. 24, 1990 [ZA] South Africa ..... 90/3093

[51] Int. Cl.[5] ..... H01R 13/00

[52] U.S. Cl. ..... 439/495

[58] Field of Search ..... 439/492–499

[56] References Cited

U.S. PATENT DOCUMENTS 3,486,159 12/1969 Matthews ..... 439/496
4,385,795 3/1983 Endoh et al. .
4,438,999 3/1984 Lang ..... 439/493
4,641,904 2/1987 Kosugi et al. .
4,721,483 1/1988 Dickie .
4,725,248 2/1988 Yasumoto .
4,887,977 12/1989 Lemke .

FOREIGN PATENT DOCUMENTS 0382482 8/1990 European Pat. Off. .
0390450 10/1990 European Pat. Off. .
3915611 5/1989 Fed. Rep. of Germany .
2643512 8/1990 France .
2205202 11/1988 United Kingdom .

*Primary Examiner*—Joseph H. McGlynn
*Attorney, Agent, or Firm*—Lowe, Price, LeBlanc & Becker

[57] ABSTRACT

A connector for joining multi-conductor cables comprising first and second mating connector elements which are fixed to first and second multi-conductor cables. The first connector element holds bared sections of the conductors of the first cable in a spaced apart relationship and defines upstanding pillars over which the conductors are folded. The second connector element holds bared sections of the conductors of the second cable in a spaced apart relationship and defines apertures adjacent to the conductors which are shaped to receive the upstanding pillars, so that respective conductors of the first and second cables are urged into electrical engagement with one another when the first and second connector elements are mated. The frictional contact between the conductors ensures a self-cleaning action.

17 Claims, 4 Drawing Sheets

CONNECTOR FOR MULTI-CONDUCTOR CABLES

BACKGROUND OF THE INVENTION

This invention relates to a connector for joining multi-conductor cables such as ribbon cables, and to a connector system comprising the connectors and cables.

In the mining industry, multi-conductor ribbon cables are used to connect electrically actuated detonators to a central controller. Typically, a four-conductor harness is provided, to which five-conductor cables from each detonator are connected. This requires connector elements to be fixed to the harness at regular intervals, to which mating connector elements can be attached, to connect the detonators to the harness.

Due to the large number of connectors used, the cost of the connectors becomes significant. In particular, given that the operational life of the connectors is very short, the provision of conventional, relatively expensive connectors in such an application is wasteful. Typically, the detonators of the system will be actuated within, say, two hours after connection of the detonators to the harness, destroying the connectors or rendering them unusable. It would thus be desirable to provide a relatively low cost connector for such applications, which need perform reliably for only a relatively short period.

SUMMARY OF THE INVENTION

According to the invention a connector for joining multi-conductor cables comprises a first connector element adapted to be fixed to a first multi-conductor cable and a second, mating connector element adapted to be fixed to a second, multi-conductor cable; the first connector element comprising a first body for holding sections of the conductors of the first cable in a spaced apart relationship and defining upstanding formations over which the spaced apart sections of the conductors are passed in use; the second connector element comprising a second body for holding sections of the conductors of the second cable in a spaced apart relationship and defining apertures adjacent to the spaced apart sections of the conductors which are shaped to receive the upstanding formations of the first connector element, so that respective conductors of the first and second cables are urged into engagement with one another when the first and second connector elements are mated.

The spaced apart sections of the conductors in the first and/or second cables are preferably bared.

The first and second cables are preferably flat ribbon multi-conductor cables.

The first and second bodies preferably each comprise upper and lower body halves which clip over bared sections of the respective cables.

DESCRIPTION OF AN EMBODIMENT

Figure 1:
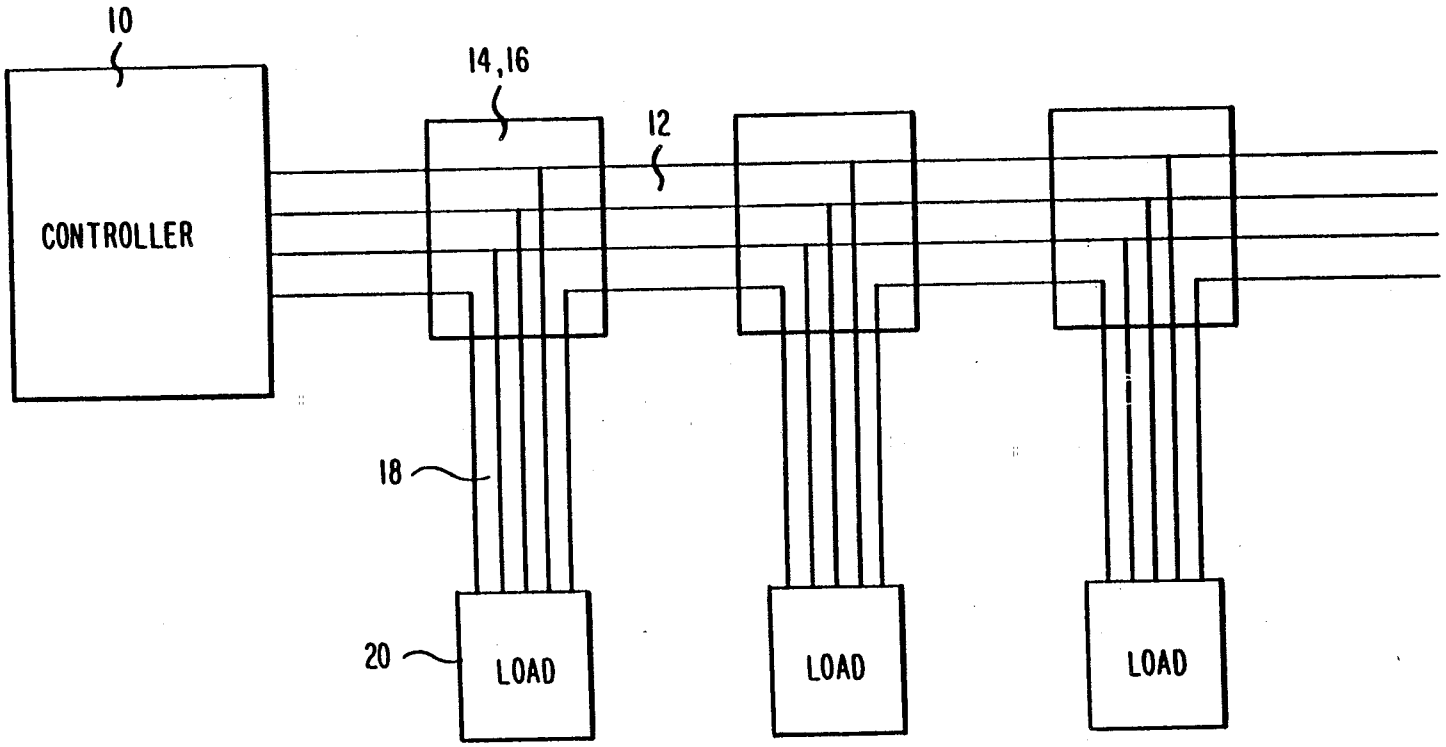
FIG. 1 is a schematic diagram of a detonator controller system employing a plurality of connectors according to the invention.

FIG. 1 illustrates a detonator controller system comprising a central electronic controller 10 to which is connected a four-conductor wiring harness 12. At intervals of approximately 1 to 2 meters, harness connector elements 14 are fixed to the harness 12, and mate with respective load connector elements 16 which are attached to 5-conductor cables 18, each are connected to a respective load 20 (typically a detonator). Typically, up to 400 detonators 20 can be connected to the harness. The conductors are typically steel wires, preferably galvanised steel wires.

The arrangement is such that three of the four wires in the harness 12 are connected in parallel to all the loads 20, while the fourth wire in the harness is connected serially to each of the loads. This therefore requires a four wire harness, with a five wire cable to each load, as indicated in FIG. 1.

The loads 20 are normally electrical or electronically activated detonators which are placed in holes which have been drilled and packed with explosives. Once the detonators have been placed in the holes, they are left standing, unconnected, until the arrival of a suitably qualified miner who connects the detonators to the harness 12, and then connects the harness to the controller 10. The controller is then operated to activate the detonators and detonate the explosives within the next two hours.

In certain mining applications, the use of harnesses and detonator cables containing certain metals is undesirable. For example, in gold mining, the use of copper conductors is undesirable, since the copper of the cables is mixed with the blasted ore and is extracted, together with gold, when the ore is processed. This contaminates the extracted gold. In coal mining, the use of aluminium conductors is undesirable, since aluminium may react with methane gas and create an explosion hazard. The use of steel conductors has certain advantages, since steel is both strong and cheap, and alleviates the above-mentioned problems. However, in the hostile environment of a mine, steel conductors tend to oxidize rapidly. In a low cost connector, in which respective steel conductors are brought into contact with one another, such oxidation can result in unreliable contact making. The connector of the invention addresses this problem by ensuring a scraping or rubbing action between the conductors of respective cables to be joined, so that dirt or oxidation is removed, and thus ensuring a good metal to metal contact. The use of galvanised steel wire also assists in reducing oxidation.

Figure 2:
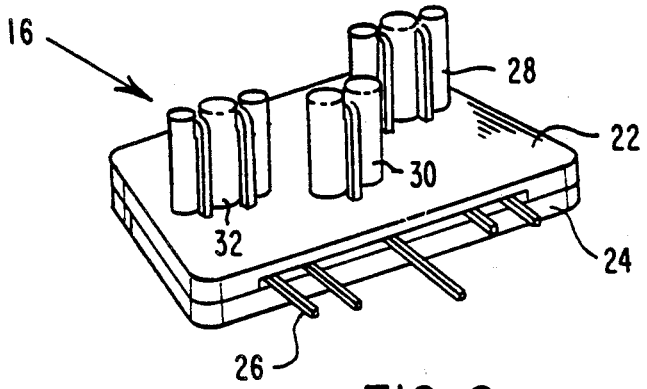
FIG. 2 is a pictorial view of a first connector element of the invention in an assembled condition.
Figure 3A:
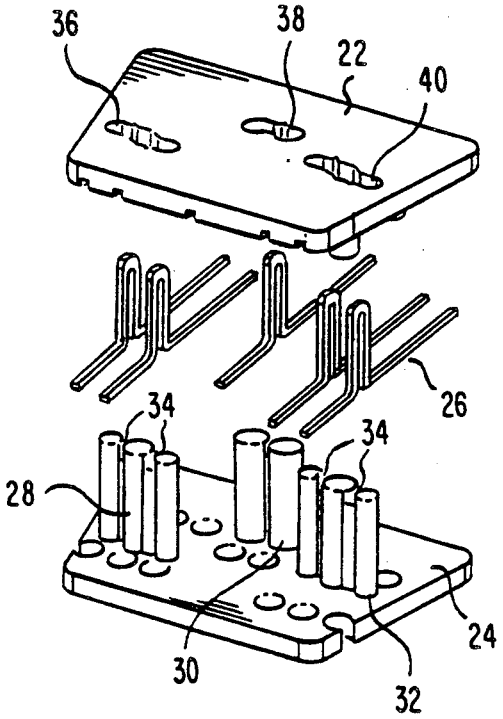
FIGS. 3*a* and 3*b* are exploded views of the connector element of FIG. 2.
Figure 3B:
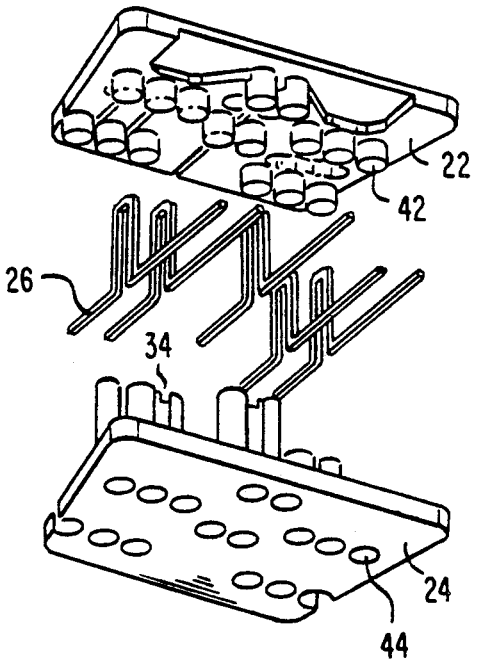

The connector of the invention comprises a pair of mating connector elements. FIGS. 2 and 3 illustrate a first, load connector element 16 which comprises a body of tough plastics material such as nylon or polypropylene. The body has an upper half 22 and a lower half 24, which clip together over a bared end 26 of the five conductor detonator cable 18. As best shown by FIGS. 3*a* and 3*b*, the lower half 24 of the body has three sets of upstanding pillars 28, 30 and 32 formed thereon. The sets 28 and 32 each comprise three pillars, with shallow slots 34 between them at their upper ends, while the set 30 comprises two pillars with a single slot 34 between them.

As illustrated, the conductors 26 are bent into a tight U or hairpin configuration and are then placed over the respective pillars so that the folded end of each U is located in a respective slot 34. The upper half 22 of the body, which has apertures 36, 38 and 40 formed therein, corresponding to the outline of the sets of pillars 28, 30 and 32, is now pushed over the pillars of the lower body half 24, securing the conductors in place over the pillars. Upstanding spigots 42 on the inner surface of the upper body half 22 clip into respective holes 44 in the lower body half 24, to secure the two halves together. The resulting load connector element is illustrated in FIG. 2, showing the wire loops held captive over the respective pillars of the connector element.

Figure 4:
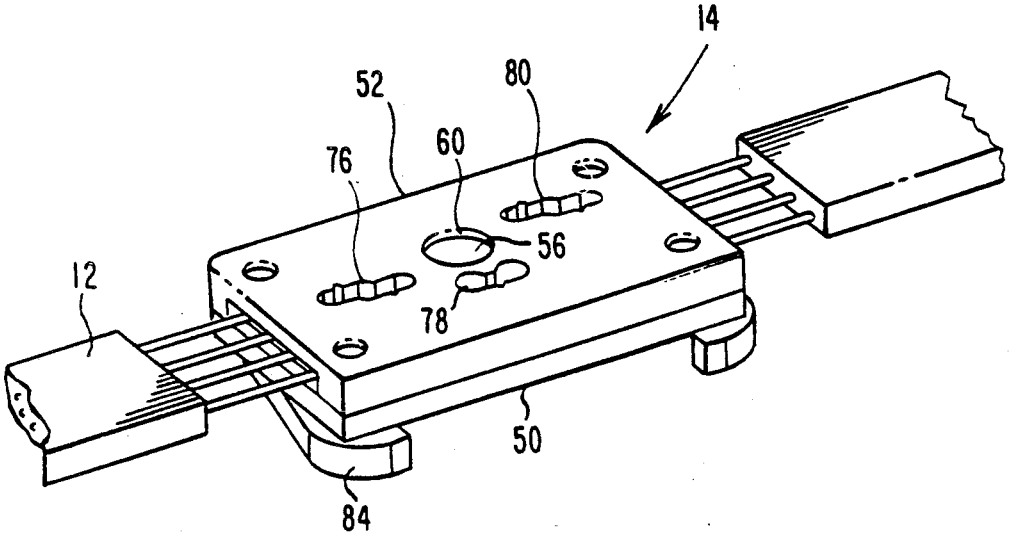
FIG. 4 is a pictorial view of a second connector element according to the invention.
Figure 6:
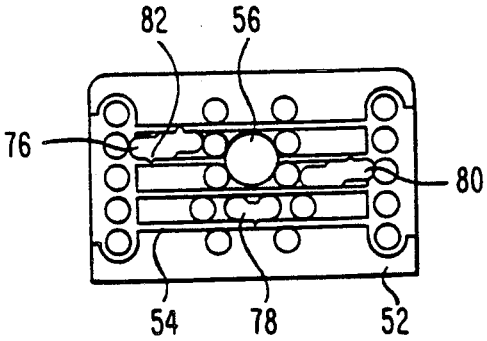
FIG. 6 is a top view of one half of the connector element shown in FIG. 4.
Figure 5B:
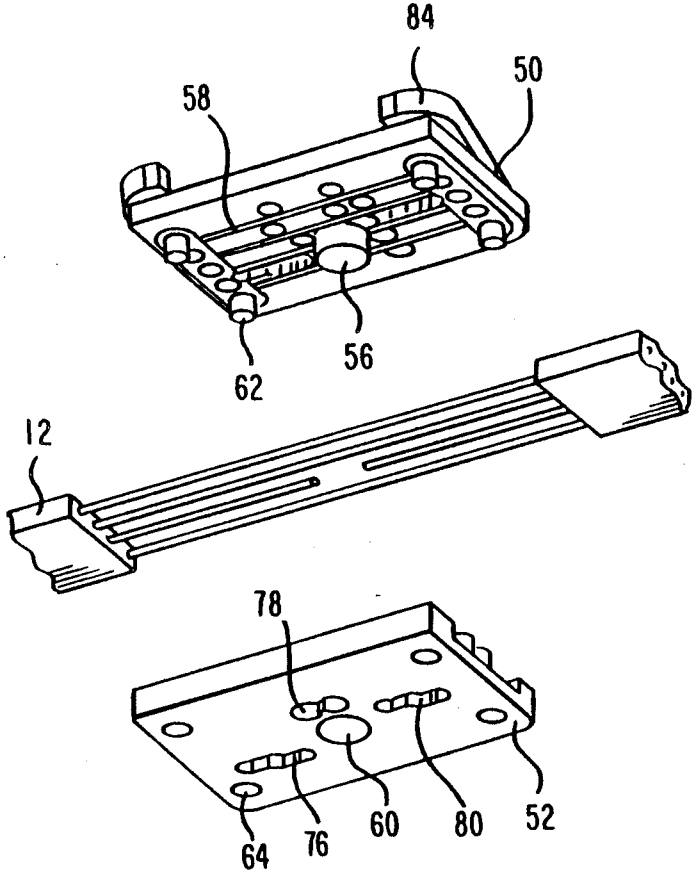
FIGS. 5*a* and 5*b* are exploded views of the connector element of FIG. 4.
Figure 5A:
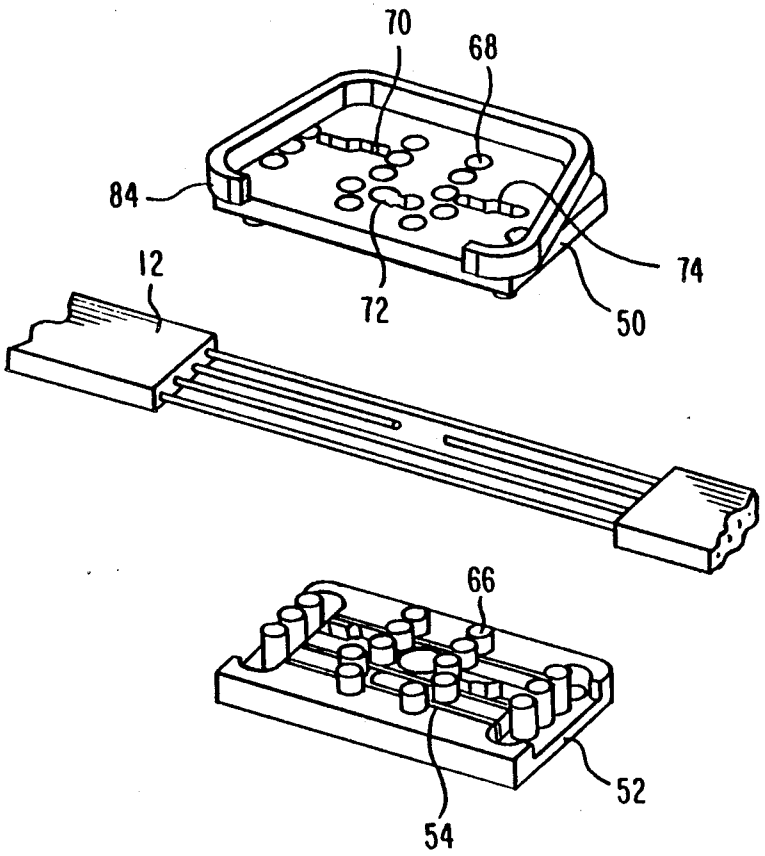

In FIG. 4, a second, harness connector element 14 is illustrated, fitted to the four conductor harness cable 12. The harness connector element also comprises upper and lower body halves 50 and 52, respectively. The lower body half 52 is illustrated in plan in FIG. 6, and can be seen to define four parallel channels 54 which receive the respective conductors of the harness cable 12. Three of the four conductors run continuously in their respective channels 54, while one of the conductors is broken by a pillar 56 which interrupts one of the channels and which breaks the conductor concerned when the upper and lower body halves 50 and 52 are pressed together around the conductor. As seen most clearly in FIG. **5*b*, the upper body half 50 is formed with ridges 58 which project slightly into the channels 54 when the two body halves are assembled, ensuring that the conductors remain securely in their respective channels. The pillar 56 is received in a complemental aperture 60 in the lower body half 52. Spigots 62 on the upper body half fit into apertures 64 in the lower body half, and spigots 66 on the lower body half fit into complemental apertures 68** in the upper body half to clip the halves together firmly when the connector element is assembled.

Both the upper and lower body halves 50 and 52 are formed with aligned sets of apertures 70, 72, 74, and 76, 78, 80, which correspond to the outlines of the sets of pillars 32, 30 and 28, respectively, on the load connector element. As seen most clearly in FIG. 6, the apertures 76, 78 and 80 in the lower body half 52 lie between the channels 54 in which the conductors of the harness cable 12 lie, and are formed with small notches or indentations 82 which project slightly into the respective channels 54.

When it is necessary to connect the detonators to the wiring harness, the load connector elements are clipped to the harness connector elements by aligning the pillars on the load connector element with the apertures in the harness connector element and pushing the elements together. A lip 84 on the upper body half 50 of the harness connector element facilitates correct alignment of the connector elements. As the pillars of the load connector element enter the apertures of the harness connector element, the respective conductors rub against one another as they are pushed together with an interference fit. This scrapes the wires clean of oxidation or other contamination, ensuring a good metal to metal contact. At the same time, any particles of sand or other debris are pushed out of the apertures by the pillars. The pillars of the load connector element are typically six millimeters long, which allows a sufficiently long stroke to ensure a good self-cleaning action.

The respective body halves of the connector elements are ultra-sonically welded together about the cable, ensuring a reliable join.

Tests have shown the connectors of the invention to perform reliably in use, and the cost of the connector elements is of the order of ten cents per load connector/harness connector pair.

Although the above described connector employs bared sections of the respective multi-conductor cables, it may be possible in certain applications to fit at least one half of the connector with non-bared conductors, with the conductors being so arranged that their insulation is stripped away by friction between respective engaging conductors as the connector elements mate.

We claim:

1. A connector for joining multi-conductor cables comprising a first connector element adapted to be fixed to a first multi-conductor cable and a second, mating connector element adapted to be fixed to a second multi-conductor cable; the first connector element comprising a first body for holding sections of the conductors of the first cable in a spaced apart relationship and defining upstanding formations over which the spaced apart sections of the conductors of the first cable are passed in use; the second connector element comprising a second body for holding sections of the conductors of the second cable in a spaced apart relationship and defining apertures adjacent to the spaced apart sections of the conductors of the second cable which are shaped to receive the upstanding formations of the first connector element, so that respective conductors of the first and second cables are urged into engagement with one another when the first and second connector elements are mated.

2. A connector according to claim 1 wherein the first and second connector elements are shaped to prevent incorrect orientation of the connector elements when they are mated.

3. A connector according to claim 1 wherein the connector elements are formed from a tough plastics material.

4. A connector according to claim 1 wherein the spaced apart sections of the conductors in the second cable are bared.

5. A connector according to claim 1 wherein the spaced apart sections of the conductors in the first and second cables are bared.

6. A connector according to claim 1 wherein the spaced apart sections of the conductors in the first cables are bared.

7. A connector according to claim 6 wherein the first and second bodies each comprise upper and lower body halves which clip over the spaced apart sections of the respective cables.

8. A connector according to claim 7 wherein the body of the first connector element comprises a lower body half having a plurality of upstanding pillars and an upper body half having a plurality of complemental apertures, so that clipping the upper and lower body halves together over a bared section of the first cables causes the free ends of the pillars to project through the apertures, with bared sections of the conductors of the first cable held captive over the pillars.

9. A connector according to claim 8 wherein sets of pillars are provided with formations at their free ends for retaining the conductors.

10. A connector according to claim 9 wherein slots are formed between the free ends of adjacent pillars for retaining the conductors.

11. A connector according to claim 7 wherein the body of the second connector element comprises a lower body half and an upper body half, both body halves having aligned apertures therein for receiving the pillars of the first connector element and at least one of the body halves defining retaining means for holding bared sections of the conductors of the second cable adjacent to the apertures.

12. A connector according to claim 11 wherein a formation is provided on at least one of the body halves of the second connector element for severing a conductor of the second cable when the body halves are fitted together about the second cable.

13. A connector according to claim 11 wherein the retaining means comprises a plurality of channels for holding the conductors in a spaced apart relationship.

14. A connector according to claim 13 wherein the retaining means further comprises a plurality of spigots arranged to separate the conductors.

15. A connector system comprising a plurality of connectors according to claim 1 and first and second multi-conductor cables.

16. A connector system according to claim 15 wherein the first and second cables are flat ribbon cables.

17. A connector system according to claim 16 wherein the conductors in the first and second cables are galvanished steel wires.

* * * * *